US007080837B2

(12) United States Patent
Voigt, IV

(10) Patent No.: US 7,080,837 B2
(45) Date of Patent: Jul. 25, 2006

(54) GAME BOARD FOR A DOMINO GAME

(75) Inventor: Carl E. Voigt, IV, Indianapolis, IN (US)

(73) Assignee: Fundex Games, Ltd., Indianapolis, IN (US)

( * ) Notice: Subject to any disclaimer, the term of this patent is extended or adjusted under 35 U.S.C. 154(b) by 300 days.

(21) Appl. No.: 10/347,850

(22) Filed: Jan. 21, 2003

(65) Prior Publication Data

US 2004/0140619 A1 Jul. 22, 2004

(51) Int. Cl.
*A63F 3/00* (2006.01)

(52) U.S. Cl. ..... 273/237; 273/236; 273/287; 463/11; 21/392; 21/396

(58) Field of Classification Search ..... 463/9, 463/11, 36–38, 46; 273/236–237, 287, 293, 273/309, 148 R; D21/392, 396, 342, 350
See application file for complete search history.

(56) References Cited

U.S. PATENT DOCUMENTS

| | | | | |
|---|---|---|---|---|
| D216,473 | S | 1/1970 | Rizzo et al. | |
| 4,428,147 | A | 1/1984 | Yoshida | |
| D279,801 | S | 7/1985 | Brockenshire | |
| 4,927,987 | A * | 5/1990 | Kirchgessner | 200/5 R |
| 5,349,129 | A | 9/1994 | Wisniewski et al. | |
| 5,725,409 | A | 3/1998 | Brunton | |
| 5,938,528 | A | 8/1999 | Glapion | |
| 5,947,474 | A | 9/1999 | Kanagawa et al. | |
| D420,709 | S | 2/2000 | Trent et al. | |
| 6,164,648 | A * | 12/2000 | Everett | 273/148 R |
| 6,176,490 | B1 | 1/2001 | Brown | |
| 6,213,467 | B1 * | 4/2001 | Andrews | 273/236 |

OTHER PUBLICATIONS

Mexican Train Dominoes, Internet acrhive May 10, 2000, 3 pages.*
Cardinal's Mexican Train Domino Game Mexican Train (1994), 9 pages.*
Cardinal's Mexican Train Domino Game (1994), Figures 1-5 (13 pages).*
Plastech Industries Co. brochure, dated Oct. 1, 1995, showing Deluxe Chicken foot Domino Game.

* cited by examiner

*Primary Examiner*—Xuan M. Thai
*Assistant Examiner*—Alex F. R. P. Rada, II
(74) *Attorney, Agent, or Firm*—Maginot, Moore & Beck

(57) ABSTRACT

A Mexican Train Dominoes game includes a game board that defines a central recess corresponding to the train station hub of the game. The recess includes a platform on which an "engine" domino tile is placed to commence the game. The platform can be depressed to activate a sound generation component that is operable to produce simulated train sounds. The game board can include a circuit board that carries a resiliently depressible switch that is operably coupled to the platform. The switch can support the platform in its normal position and can restore the platform to that normal position after the "engine" domino and platform have been depressed during game play.

49 Claims, 3 Drawing Sheets

GAME BOARD FOR A DOMINO GAME

CROSS REFERENCE

Cross reference is made to co-pending U.S. patent application Ser. No. 29/174,518, entitled "Domino Game Hub" by Carl E. Voigt, IV filed on the same date herewith (now U.S. Patent No. D484,922).

BACKGROUND OF THE INVENTION

This invention relates to the field of recreational board games, and particularly to a domino board game. More specifically, the invention relates to improvements in the game of "Mexican Train Dominoes".

The game of dominoes has been played for centuries. The basic concept of most domino games is to eliminate or reduce the number of dominoes that a player has by matching them to dominoes previously laid during game play. Typically, the dominoes are matched by having like numbers of dots at one end of each domino.

Through the years, many variations of the domino game have evolved. One such variation is known as "Mexican Train Dominoes" in which players build "trains" of dominoes. A typical Mexican Train dominoes game will include player markers in the form of miniature train engines of different colors. This train engine marker is used to indicate the status of a player's individual domino track.

The root of the game name is the Mexican Train that is independent of the player's trains and on which all players can lay a domino tile. A number of Mexican Trains can be created during game play, which provides the players with more play options to lay domino tiles. When play is begun, a single domino is centrally placed which serves as the "engine" for the game. Players must begin their individual train with a domino that matches with the engine. In addition, new Mexican Trains can be created when a tile is drawn that matches the engine.

As with most board games, part of the fun is the interaction between players and between the players and the game itself. There is always a need for improvements to these board games, such as the Mexican Train Dominoes game, that add to the fun and excitement of the players.

SUMMARY OF THE INVENTION

In order to meet this need, the present invention contemplates improvements to the basis Mexican Train Dominoes game board. In one embodiment, the board provides a central hub for receipt of the "engine" domino. The board defines a plurality of starting locations for the players, which can be in the form of notches defined in the circumference of the board that are sized to receive one end of a domino. Each player is provided with a miniature train engine marker for use throughout the game.

The surface of the game board can include decorative features suggestive of the game itself. For instance, in one embodiment, the board includes a representation of a beginning train track segment that runs between each domino starting notch and the central train station hub. In one aspect of the invention, the representation of the track segment includes an upstanding ridge that can be used to support the player's train engine marker during certain game conditions. In the typical Mexican Train Dominoes game, a player starts with his/her train marker at the track segment. If the player has a playable domino tile, the train is removed from the track segment and placed at the end of the developing track of dominoes. However, if during game play a player is unable to lay a domino tile at the end of his/her personal track, the train marker must be returned to the track segment as an indication to the other players that his/her individual track is available for plays by the other players. Consequently, each player's train engine marker will likely spend a great deal of time on the beginning track segment during the course of a game. The upstanding ridge of the present invention helps retain the train engine marker in position on the game board so that it is readily visible to the other players.

Another feature of the invention adds to the excitement of play. This feature provides a movable platform at the train station hub on which the "engine" domino is placed to begin game play. The movable platform is operably coupled to a switch that can be triggered to initiate the sound of a train and train whistle. During game play, if a domino tile is drawn that matches the "engine", a player can begin a new Mexican Train track. The player then signals the advent of this new train by depressing the "engine" and ultimately the hub platform to activate the switch. The other players have an audio signal that a new Mexican Train track is available for play. The signal also adds to the train ambiance of the game. When a player plays his/her last tile, the player can also depress the "engine" tile to signify the end of the game. Of course, this signal is less satisfying to the other players because it means that they must make a tally of the dots on their remaining dominoes. Nevertheless, the simulated train sounds add to the flavor and fun of the game, especially for the winner.

DESCRIPTION OF THE PREFERRED EMBODIMENT

Figure 1:
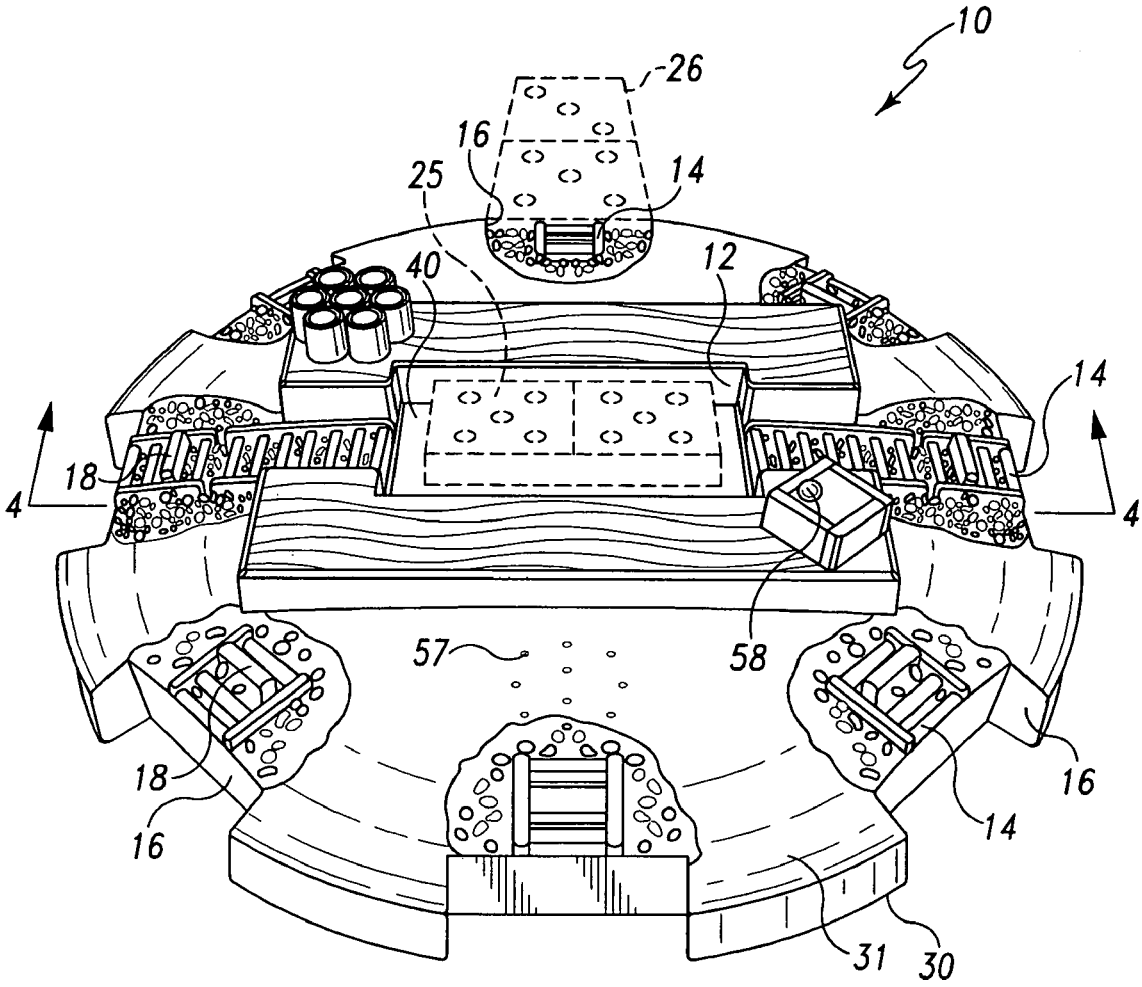
FIG. 1 is a perspective view of the Mexican Train Dominoes game board in accordance with one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Referring to FIG. 1, a game board 10 is provided as part of a Mexican Train Dominoes game. The game board is preferably formed as a housing 30 that includes an upper housing 31 and a lower housing 32 (see FIG. 3). Preferably, the housing is molded from material commonly used for games, such as plastic. The upper and lower housings 31, 32 can be connected in any known manner, such as by screws, snap-fit or even epoxy.

The game board is configured to facilitate the playing of the Mexican Train game in accordance with the standard rules of the game. Thus, the housing 30, and particularly the upper housing 31, can bear various ornamental and functional features. For instance, the upper housing 31 defines a centrally located train station hub 12 that is used to receive the "engine" domino 25, shown in phantom lines in the figure. The hub 12 is preferably recessed within the game board 10 and is sized to comfortably receive the "engine" domino. The hub recess is preferably sized to provide finger clearance around the domino so that the domino can be manually removed when the game is over.

The housing also defines a plurality of player location corresponding to the maximum number of players allowed for the game. Emanating from the train station hub 12 are a plurality of train track segments 14. These track segments correspond to the position of the game players and represent the starting point for the individual train of each player. The number of track segments normally corresponds to the number of players for the game. The track segments 14 terminate at the perimeter of the upper housing 31 in a notch 16, as shown best in FIG. 3. The notch is sized to receive a player's initial train track domino, such as the domino 26 shown in phantom in FIG. 1. The notch 16 is preferably sized so that the initial train track domino can only be positioned lengthwise in the notch, as shown in FIG. 1. In this way, the starting domino 26 gives the appearance of continuing the track segment 14 outside the game board 10.

Figure 2:
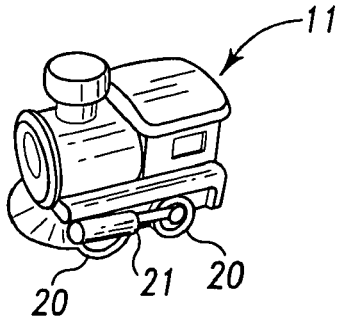
FIG. 2 is a perspective view of a train engine marker used with the game board shown in FIG. 1.

As is traditional with the Mexican Train Dominoes game, each player is provided with a game marker, such as the train engine marker 11 shown in FIG. 2. This marker 11 is placed on the free end of a player's domino track when that player has a domino tile to play. Alternatively, the marker 11 is placed on the starting track segment 14 when the player cannot place a tile on his/her domino track. This placement of the marker provides a visual indication to the other players that that person's personal track is available for placement of tiles by the other players. In order to facilitate the display of the individual train markers 11, the track segment 14 is provided with an upstanding ridge 18. The train marker 11 is provided with wheels 20 that define a recess 21 therebetween. The recess 21 is complementary to the ridge 18 so that the train marker can rest over the ridge. The ridge 18 will prevent movement of the train marker 11 during game play.

Figure 4:
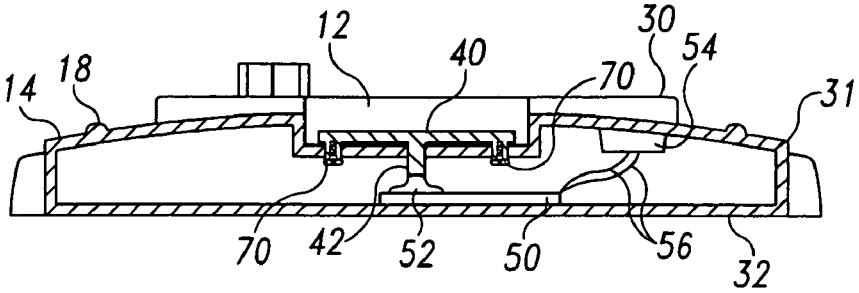
FIG. 4 is a side cross-sectional view of the game board shown in FIG. 1, taken along line 4—4 as viewed in the direction of the arrows.

The present invention contemplates certain features to the game board 10 that enhances the playing of the game and the enjoyment of the participants. In one feature, the game board is provided with a system for replicating the sound of a passing locomotive and train whistle. In the preferred embodiment, the central hub 12 includes a hub platform 40 (see FIGS. 1, 4 and 5) on which the "engine" tile is placed at the beginning of the game. The platform 40 is operatively coupled to a switch 52, as shown in FIG. 4, so that the platform 40 can be depressed to toggle or activate the switch. The switch 52 can be part of a sound generation component or circuit board 50 that includes circuitry to generate sounds that simulate a train locomotive. Of course, the generated sounds can simulate other sounds associated with a train to add to the ambiance of the game. The circuit board is connected by wiring 56 to a speaker 54 that is supported on the housing 30. The speaker can be of known construction for low power, fixed volume operation. Preferably, the speaker is supported beneath sound openings 57 (FIG. 1) defined in the upper housing 31.

The circuit board can also be connected to an indicator light 58 (FIG. 1) that can be energized while the speaker 54 is active. The indicator light would supplement the audible signal with a visual indication of the current game play. The indicator light 58 can be an LED with its power supplied by the circuit board 50 when the switch 52 is actuated.

Figure 3:
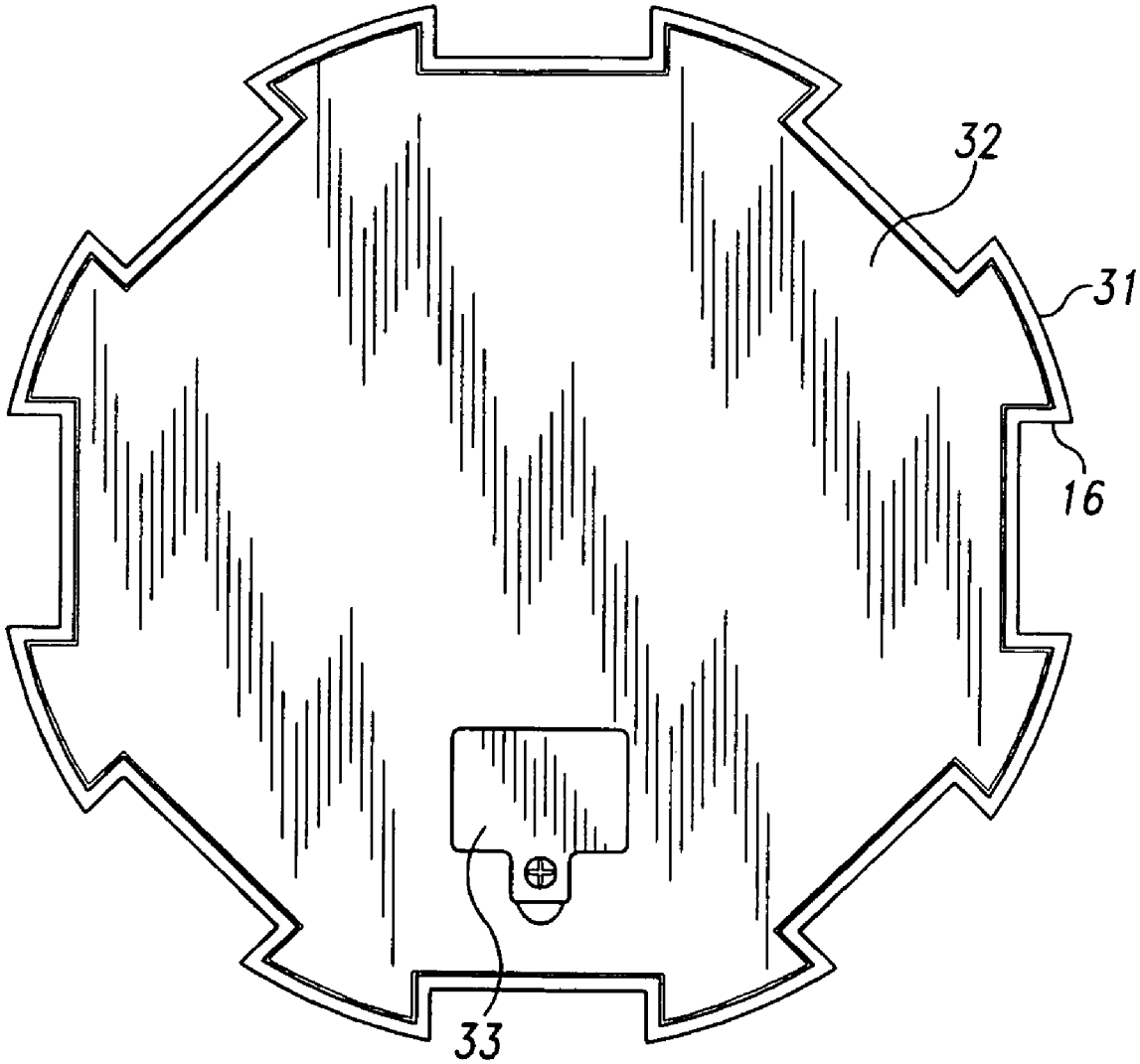
FIG. 3 is a bottom view of the game board shown in FIG. 1.

The circuit board can be of any known type capable of replaying a prerecorded or pre-determined sound. The circuitry can include a sound generator component that is capable of generating a synthesized sound. The circuit board may include a microprocessor, especially where different selectable sound sequences are desired. However, in the most preferred embodiment, the circuitry is of the known analog type. A power supply (not shown), such as a battery may be mounted to the circuit board or may be separately mounted within the housing 30 and wired to the circuit board in a known manner. An access door 33 may be provided in the housing, such as in the lower housing 32 as shown in FIG. 3, to provide access for replacement of the power supply, or battery.

The present invention contemplates means are provided for biasing the platform 40 away from the switch. In one embodiment, this means for biasing is incorporated into the switch 52, which can be a resilient, depressible switch of known configuration. As is known, the resilient switch can spring back after being depressed and can incorporate an internal spring or spring washer. In this preferred embodiment, the resilient switch 52 can essentially support the hub platform 40. Thus, the hub platform includes an actuation component 42 for actuating the switch when the platform is depressed. In one embodiment, that component is in the form of a downwardly extending boss 42 that extends into the interior of the housing 30 into contact with the resilient switch 52. When the platform 40 is depressed by a player pressing on the "engine" domino, the actuation boss 42 pushes against and actuates the switch 52. Preferably the switch is an instantaneous switch, meaning that it need not be maintained in its depressed position for the circuit board 50 to commence and complete its sound generation function. In this case, once the switch has been initially closed or actuated, the resilient nature of the switch 52 will push back against the actuation boss 42 and push the hub platform back up to its normal position.

Figure 5:
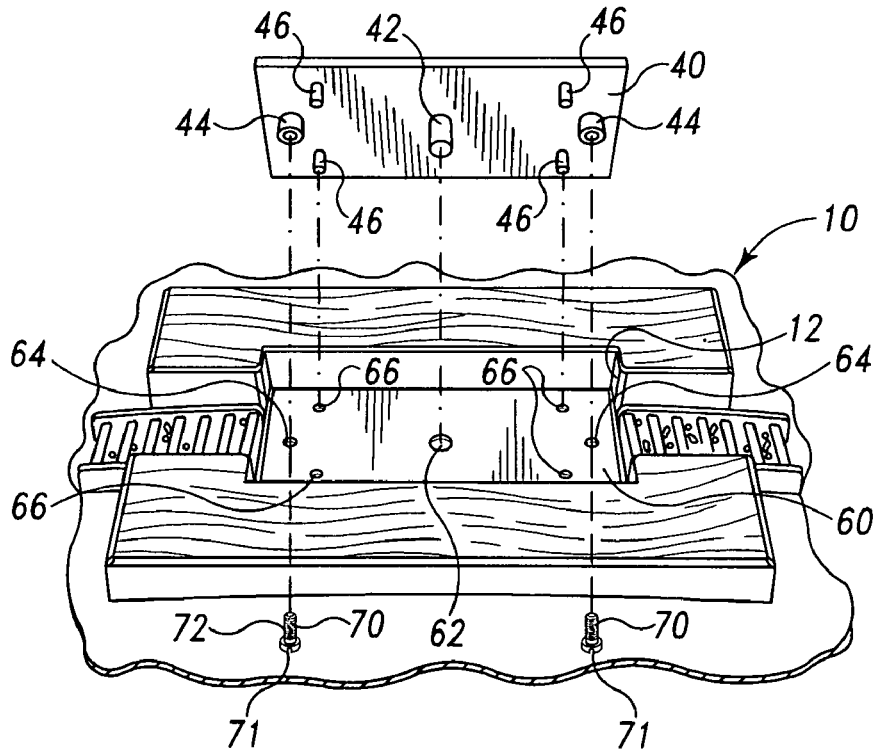
FIG. 5 is partial view of the hub portion of the game board shown in FIG. 1, with the hub platform shown in exploded view.

In order to hold the hub platform in position, the housing is provided with a mounting plate 60 at the base of the train station hub 12, as shown in the detail view of FIG. 5. The mounting plate 60 includes a central boss opening 62 through which the actuation component 42 extends when the hub platform 40 is disposed within the hub recess 12. To retain or capture the platform 40 within the hub recess, the platform can be provided with retainer bosses 44 that extend downwardly and generally parallel to the actuation boss 42. These bosses 44 extend through corresponding retainer openings 64 in the mounting plate 60. Preferably, two such retainer bosses and corresponding retainer openings are provided at opposite long ends of the hub 12. The retainer bosses are configured to be engaged to retainers 70. The retainers 70 can include a head 71 that is larger than the retainer opening 64, and a stem 72 that is configured for engagement with the retainer boss 44. Preferably, the retainer boss 44 and stem 72 of the retainer 70 define a threaded engagement, such in the form of a threaded bore and screw combination. However, other permanent or semi-permanent engagements are contemplated, such as a press-fit or the use of an adhesive. Regardless of the form of engagement, the hub platform 40 is captured in position within the housing by the retainer bosses 44 and corresponding retainers 70.

To ensure that the hub platform does not bind within the hub recess 12 during actuation, the platform can also include a plurality of guide posts 46 projecting downward into the housing. More specifically, the guide posts extend through guide openings 66 defined in the mounting plate 60, as shown in FIG. 5. The guide posts 46 are preferably offset from a line between the retainer bosses so that the posts can provide lateral or tilt stability to the hub platform 40. Most preferably, the platform includes two such posts at each long end of the mounting plate 60, with the two posts offset laterally from the centerline between the retainer bosses, as depicted in FIG. 5. With this arrangement, the hub platform 40 is not likely to tilt or bind within the hub recess and the platform will move smoothly and linearly when the platform is depressed.

Figure 6:
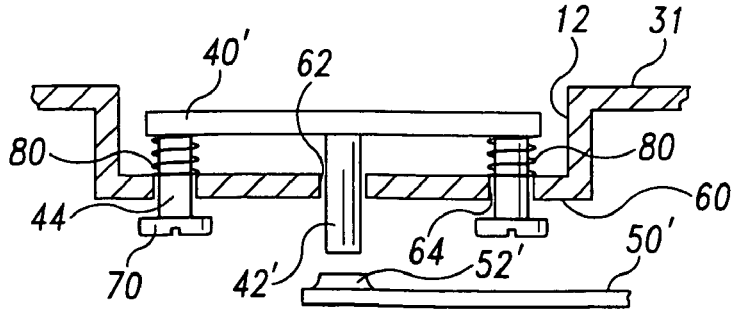
FIG. 6 is a cross-sectional partial view of the hub portion of the game board in accordance with another embodiment of the invention.

In the preferred embodiment, the switch 52 is a resilient switch that provides the restoring force to return the hub platform 40 to its normal, undepressed position within the hub recess 12. Alternatively, the restoring force can be provided by separate springs acting directly in the hub platform itself. Thus, as shown in FIG. 6, a modified hub platform 40' can be provided with a modified actuation boss 42' that is used to activate a modified switch 52'. The switch 52' is not a resilient switch, meaning that it is not operable to provide a restorative force to the hub platform after the switch has been depressed. The switch 52' can be a depressible switch, or it can be in the form of adjacent contacts. In the latter case, the modified boss 42' can be provided with a bridging contact to complete the circuit between the contacts of the switch 52'. In either case, the switch itself is not relied upon to return the hub platform 40' to its normal position.

The platform 40' includes retainer bosses 44 that are engaged to retainers 70, both components of which can be the same as described above. However, with this embodiment, the means for biasing the platform away from the switch can include a spring 80 disposed about each retainer boss 44 between the hub platform 40' and the mounting plate 60. The springs 80 thus generate an upward force on the hub platform 40' when it is depressed to restore the platform to its normal position. The platform 40' can still include the guide posts 46 described above to keep the platform stable when it is depressed.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

For instance, in the preferred embodiments of the invention, the switch 52, 52' that activates the sound generation function is mounted on a circuit board remote from the hub platform 40, 40' that is depressed to activate the switch. Alternatively, the switch can be mounted on the mounting plate 60 of the upper housing 31 directly beneath the hub platform 40, 40'. The switch can be electrically connected to the circuit board 50 by appropriate wiring.

In addition, the switch 52' is described as a resilient, push-button type switch. Alternatively, the switch can be a toggle switch. The toggle can be connected to the hub platform 40' so that the switch is toggled down when the platform is depressed and is toggled up when the platform is pushed upward by the springs 80.

Yet another alternative concerns the speaker 54. In the illustrated embodiment, the speaker is shown advantageously mounted to the upper housing 31 beneath speaker holes 57. Optionally, the speaker may be mounted within the housing and even on the circuit board. As a further alternative, the speaker can be eliminated if the sound generation component is capable of producing a synthesized sound without the need for a traditional speaker.

What is claimed is:

1. A game board for a domino game comprising:

a housing defining a central recess sized to receive a domino tile therein and further defining a plurality of player locations around the perimeter of the housing;

a sound generation component operable to generate sounds simulating a train;

a switch connected to said sound generation component and operable when actuated to activate said sound generation component; and a platform mounted within said central recess and having a surface for supporting the domino tile thereon, said platform further having a component for actuating said switch when a player depresses the domino tile supported on said platform.

2. The game board of claim 1, further comprising an indicator light connected to said sound generation component or said switch and operable to illuminate when said switch is actuated.

3. The game board of claim 1, wherein said switch is a resilient depressible switch.

4. The game board of claim 1, wherein:

said platform includes an actuation component projecting therefrom; and said central recess includes a mounting plate disposed between said platform and said switch, said platform defining an actuation opening sized to receive said actuation component therethrough, whereby said actuation component is configured to actuate said switch when a player depresses the domino tile supported on said platform.

5. The game board of claim 4, wherein said switch is a resiliently depressible switch.

6. The game board of claim 5, wherein said actuation component is configured to maintain contact with said resiliently depressible switch so that said switch supports said platform above said mounting plate.

7. The game board of claim 4, wherein:

said mounting plate defines a number of retainer openings separate from said actuation opening; and said platform includes a number of retaining elements, each extending through a corresponding one of said retainer openings, said retaining elements configured to capture said platform on said mounting plate.

8. The game board of claim 4, wherein:

said mounting plate defines a number of guide openings; and said platform includes a number of guide posts projecting therefrom, each sized to slidably extend through a corresponding one of said guide openings.

9. The game board of claim 1, further comprising means for biasing said platform away from said switch.

10. The game board of claim 9, wherein said means for biasing includes said switch being resiliently depressible.

11. The game board of claim 1, further comprising a speaker associated with the housing and electrically connected to said sound generation component.

12. The game board of claim 11, wherein said speaker is mounted to the interior of said housing and said housing defines a number of speaker openings through said housing adjacent said speaker.

13. A game board for a dominoes game comprising:

a housing defining a domino slot structure configured to receive a domino tile therein, said housing further having defined therein a plurality of notches located at a perimeter of said housing, each of said plurality of notches being configured to receive an end portion of another domino tile therein;

a sound generator operable to generate audible sounds; and a platform movably mounted within said domino slot structure, wherein movement of said platform from a first position to a second position causes said sound generator to generate audible sounds.

14. The game board of claim 13, further comprising a switch connected to said sound generator and operable when actuated to activate said sound generator, wherein movement of said platform from said first position to said second position causes activation of said switch.

15. The game board of claim 13, further comprising at least one spring configured to bias said platform into said first position.

16. The game board of claim 13, further comprising an indicator light operable to illuminate, wherein movement of said platform from said first position to said second position further causes said indicator light to illuminate.

17. The game board of claim 13, wherein:

said domino slot structure defines a rectangular-shaped recess, and said platform includes a rectangular-shaped support member movably mounted within said rectangular-shaped recess.

18. The game board of claim 15, wherein said rectangular-shaped support member is movable between a raised position and a lowered position.

19. The game board of claim 15, wherein said rectangular-shaped support member is spring biased toward said raised position.

20. A domino game assembly comprising:

a housing having defined therein a plurality of notches located at a perimeter of said housing, each of said plurality of notches being configured to receive an end of a respective domino tile therein;

a sound generator positioned within said housing and operable to generate audible sounds simulating a train; and a domino tile support movable between a raised position and a lowered position, wherein movement of said domino tile support from said raised position to said lowered position causes said sound generator to generate said audible sounds.

21. The domino game assembly of claim 20, wherein said housing further having at least one train track segment structure supported thereon.

22. The domino game assembly of claim 20, wherein said sound generator includes a speaker positioned within said housing.

23. The domino game assembly of claim 20, further comprising a switch connected to said sound generator and operable when actuated to activate said sound generator, wherein movement of said domino tile support from said raised position to said lowered position causes activation of said switch.

24. The domino game assembly of claim 20, further comprising at least one spring configured to bias said domino tile support towards said raised position.

25. The domino game assembly of claim 20, further comprising an indicator light operable to illuminate, wherein movement of said domino tile support from said raised position to said lowered position further causes said indicator light to illuminate.

26. The domino game assembly of claim 20, wherein said domino tile support includes a rectangular-shaped support.

27. The domino game assembly of claim 26, wherein:

said housing defines a domino slot structure configured to receive a domino tile therein, and said rectangular-shaped support is movably mounted within said domino slot structure.

28. The domino game assembly of claim 27, wherein said rectangular-shaped support member is spring biased toward said raised position.

29. The domino game assembly of claim 20, wherein:

said housing defines a domino slot structure configured to receive a domino tile therein, and said domino tile support is movably mounted within said domino slot structure.

30. A domino game assembly comprising:

a housing defining a chamber and having at least one train track segment structure supported thereon;

a sound generator positioned within said chamber and operable to generate audible sounds simulating a train; and a domino tile support movable between a raised position and a lowered position, wherein movement of said domino tile support from said raised position to said lowered position causes said sound generator to generate said audible sounds.

31. The domino game assembly of claim 30, wherein said sound generator includes a speaker positioned within said chamber.

32. The domino game assembly of claim 30, further comprising a switch connected to said sound generator and operable when actuated to activate said sound generator, wherein movement of said domino tile support from said raised position to said lowered position causes activation of said switch.

33. The domino game assembly of claim 30, further comprising at least one spring configured to bias said domino tile support towards said raised position.

34. The domino game assembly of claim 30, further comprising an indicator light operable to illuminate, wherein movement of said domino tile support from said raised position to said lowered position further causes said indicator light to illuminate.

35. The domino game assembly of claim 30, wherein said domino tile support includes a rectangular-shaped support.

36. The domino game assembly of claim 35, wherein:

said housing further defines a domino slot structure configured to receive a domino tile therein, and said rectangular-shaped support is movably mounted within said domino slot structure.

37. The domino game assembly of claim 27, wherein said rectangular-shaped support member is spring biased toward said raised position.

38. The domino game assembly of claim 30, wherein:

said housing further defines a domino slot structure configured to receive a domino tile therein, and said domino tile support is movably mounted within said domino slot structure.

39. A domino game assembly comprising:

a housing defining (i) a chamber, and (ii) a domino slot structure configured to receive a domino tile therein;

a sound generator positioned within said chamber and operable to generate audible sounds; and a domino tile support movable within said domino slot structure between a first position and a second position, wherein movement of said domino tile support from said first position to said second position causes said sound generator to generate said audible sounds.

40. The domino game assembly of claim 39, wherein said sound generator includes a speaker positioned within said chamber.

41. The domino game assembly of claim 39, further comprising a switch connected to said sound generator and operable when actuated to activate said sound generator, wherein movement of said domino tile support from said first position to said second position causes activation of said switch.

42. The domino game assembly of claim 39, further comprising at least one spring configured to bias said domino tile support towards said first position.

43. The domino game assembly of claim 39, further comprising an indicator light operable to illuminate, wherein movement of said domino tile support from said first position to said second position further causes said indicator light to illuminate.

44. The domino game assembly of claim 39, wherein said domino tile support includes a rectangular-shaped support.

45. The domino game assembly of claim 44, wherein said rectangular-shaped support is movably mounted within said domino slot structure.

46. A domino game assembly comprising:

a housing having at least one train track segment structure supported thereon, said housing defining (i) a chamber, (ii) a plurality of notches configured to receive an end of a respective domino tile therein, and (iii) a domino slot structure configured to receive a domino tile therein;

a sound generator positioned within said chamber and operable to generate audible sounds simulating a train; and a domino tile support movable within said domino slot structure between a first position and a second position, wherein movement of said domino tile support from said first position to said second position causes said sound generator to generate said audible sounds.

47. The domino game assembly of claim 46, further comprising at least one spring configured to bias said domino tile support towards said first position.

48. The domino game assembly of claim 46, wherein said sound generator includes a speaker positioned within said chamber.

49. The domino game assembly of claim 46, further comprising a switch connected to said sound generator and operable when actuated to activate said sound generator, wherein movement of said domino tile support from said first position to said second position causes activation of said switch.

* * * * *